US005827131A

United States Patent [19]

Mahaffey et al.

[11] Patent Number: 5,827,131

[45] Date of Patent: Oct. 27, 1998

[54] LAMINATED LIGHTWEIGHT INSERTS FOR GOLF CLUB HEADS

[75] Inventors: Steven J. Mahaffey, Hampden, Mass.; Daniel A. Melanson, Avon, Conn.

[73] Assignee: Lisco, Inc., Tampa, Fla.

[21] Appl. No.: 637,029

[22] Filed: Apr. 24, 1996

[51] Int. Cl.[6] ..... A63B 53/04

[52] U.S. Cl. ..... 473/342; 473/345; 473/349

[58] Field of Search ..... 473/324, 342, 473/349, 345, 346, 350, 329, 332

[56] References Cited

U.S. PATENT DOCUMENTS

| | | | |
|---|---|---|---|
| 4,801,146 | 1/1989 | Honma | 473/342 |
| 4,884,812 | 12/1989 | Nagasaki | 473/342 |
| 5,242,168 | 9/1993 | Aizawa | 473/332 |
| 5,288,070 | 2/1994 | Chen | 473/332 |
| 5,299,807 | 4/1994 | Hutin | 473/329 |
| 5,377,986 | 1/1995 | Viollaz | 473/342 |
| 5,524,331 | 6/1996 | Pond | 473/342 |

FOREIGN PATENT DOCUMENTS 1 534 144 7/1968 France .

*Primary Examiner*—Sebastiano Passaniti
*Attorney, Agent, or Firm*—Donald R. Bahr; Laubscher & Laubscher

[57] ABSTRACT

Golf club heads, both woods and irons, have recessed areas in the striking faces of the club heads with an insert secured therein. The insert is of a laminated structure having multiple layers and so constructed that the outer layers are of a substantially high strength to weight material and the center layers are of a relatively lower weight material. This structure allows the insert to be reduced in weight so as to allow the weight difference to be repositioned about the perimeter of the club head to achieve optimum weight distribution.

12 Claims, 1 Drawing Sheet

FIG. 1
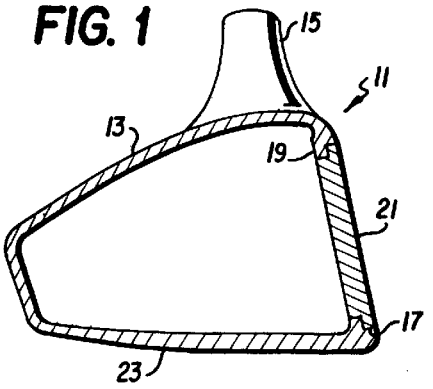
FIG. 2
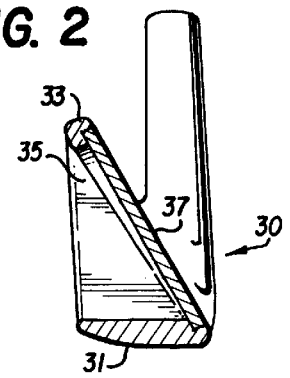
FIG. 3
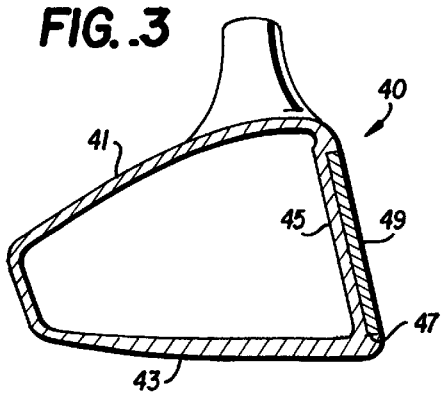
FIG. 4
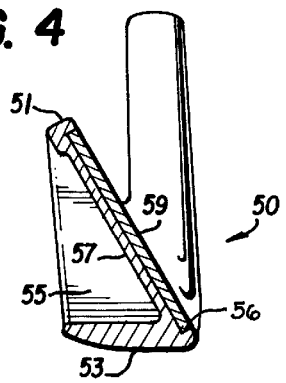
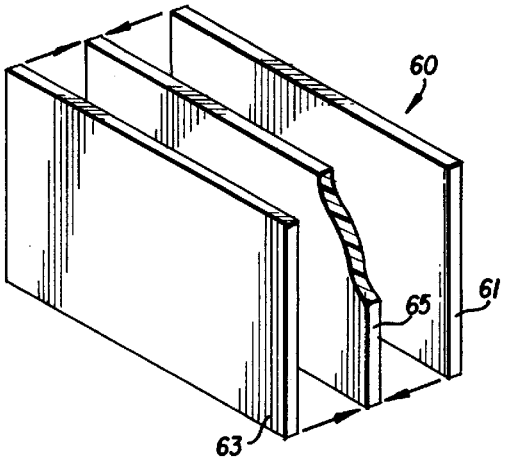
FIG. 5
FIG. 6
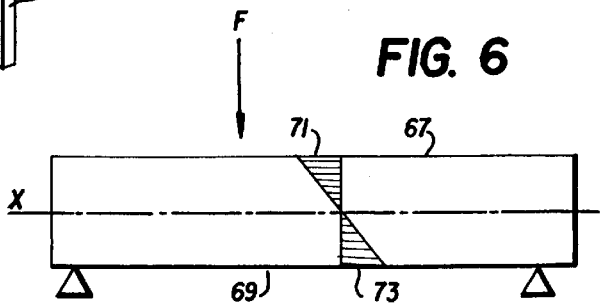

LAMINATED LIGHTWEIGHT INSERTS FOR GOLF CLUB HEADS

BACKGROUND OF THE INVENTION

This invention relates generally to golf club heads and more specifically to golf club heads having inserts in the striking face.

Golf clubs are designated primarily in separate categories of woods, iron, and putters. The majority of golf club woods at the present time are made of some metal or composition, while most irons are made of varying types of metal. Woods can be constructed of solid metal or can be constructed so as to have recesses in which a face or insert is placed in the striking surface. While most irons are made of metal, some also have recesses for accepting inserts for the striking face.

It is recognized that advantages are provided by redistributing the weight of golf clubs in both woods and irons so that the weight around the perimeter of the head increases to increase the moment of inertia, which increases head stability, which in turn lessens head rotation that imparts side spin on the ball. This creates either a hook or slice (which is the same as a gear effect) through impact on off-center hits.

The present invention discloses the use of various modifications of inserts so configured that part of the weights of the insert used can be redistributed to the perimeter of the head so as to increase the moment of the head.

This and other objects will become apparent from the following description taken together with the drawings.

SUMMARY OF THE INVENTION

The present invention provides golf club heads, both woods and irons, with recessed areas in the striking faces of the club heads and an insert secured within the recessed areas. The insert is of a laminated structure having multiple layers and is so constructed that the outer layers are of a substantially high strength to weight material and the center part is of a relatively lower weight material. This structure allows the face thickness of the insert to be minimized with the major portion of the material previously required in the face to be repositioned about the perimeter of the club head to achieve optimum weight distribution.

BRIEF DESCRIPTION OF THE DRAWINGS

FIGS. 1 and 2 are sectional views of wood-type and iron-type golf club heads, respectively, having inserts connected therewith according to a first embodiment;

FIGS. 3 and 4 are sectional views of wood-type and iron-type golf club heads, respectively, having inserts connected therewith according to a second embodiment;

FIG. 5 is an exploded view of the laminated insert according to the invention; and FIG. 6 is a diagram illustrating the tensile forces in the laminated insert of the invention.

DETAILED DESCRIPTION

FIG. 1 shows metal wood 11 having crown 13, hosel 15, and sole 23, with a face structure 19 having recess 17 therein. In this particular configuration, the recess includes a lip surrounding the recess and insert 21 is configured so as to fit within the recess and be secured therein adjacent the lip. This is commonly referred to as an unsupported insert since the club head does not have a complete surface backing adjacent the major portion of the insert.

FIG. 2 shows iron 30 having sole 31, top edge 33, and recess 35. Again, this recess has a lip against which insert 37 is placed. This also provides an iron with an unsupported face insert.

FIG. 3 shows metal wood 40 having crown 41, sole 43, and recess 47 in the face, with the recess terminating in thin plate member 45 at the interior of the club head. Plate member 45 preferably has a thickness between 0.030 inch and 0.120 inch. Insert 49 is secured within the recess and abuts against plate 45.

FIG. 4 shows iron 50 having sole 53, upper ridge 51, and cavity 55, with recess 56 being backed by thin plate 57. Plate 57 is of a thickness between 0.030 and 0.120 inch. In this type of iron, insert 59 is secured within the recess and abuts against metal layer 57.

While the inserts of the present invention are of a laminate structure, such structure is not shown specifically in the FIGS. 1–4 for purposes of clarity.

FIG. 5 shows insert 60, which is a laminate comprised of outer layers 61 and 63 and inner layer 65. In order to reduce the weight at the center, outer faces 61 and 63 are of a high strength material such as 6–4 titanium and are of a reduced thickness between 0.025 inch and 0.100 inch. Inner layer 65 is of a lighter weight material such as compression molded graphite.

FIG. 6 is a schematic illustration of the principle of the present invention. The insert of the present invention is similar to beam or bridge theory. During impact, the force F causes face 67 to flex rearwardly as it exerts force on the ball in the forward direction opposite force F. This insert acts as a beam or a bridge. For a regular insert of one material and thickness, when the face flexes rearwardly its outer surface is in compression and also withstands the highest stress levels. These forces are shown in section 71. Rearward surface 60 is in tension equal and opposite to the face compression, with tension being illustrated in section 73 of FIG. 6.

All sections between the outer surfaces are in varying degrees of tension and compression in relation to the axis X of the moment of inertia shown in the cross section. At axis F, the stress is 0.

With the design of the present insert, since the center axis sees relatively low bending stresses, as much weight as possible is removed from that center section without degrading the structure to the point where failure will occur. In this design, the materials of a multi-laminated insert match the maximum stress for the material with its relation to the axis of moment of inertia of the insert and the forces applied thereto. Accordingly, the optimum lightweight insert can be formed using this laminated structure. As set forth above, this permits the positioning of the removed weight of the insert about the periphery of the club head.

The following list presents examples of further materials which may be used for the inserts:

| MATERIAL | TENSILE | YIELD | DENSITY |
|---|---|---|---|
| 356 ALUMINUM | 40000 | 27000 | 0.097 |
| 7075 ALUMINUM | 83000 | 73000 | 0.101 |
| FORGING BRASS | 55000 | 20000 | 0.305 |
| BE—CU | 110000 | 90000 | 0.297 |
| 304 STAINLESS | 85000 | 35000 | 0.290 |
| 431 STAINLESS | 125000 | 95000 | 0.280 |
| 17-4 STAINLESS | 150000 | 110000 | 0.280 |
| 99.0% TITANIUM | 79000 | 63000 | 0.163 |
| 6-4 TITANIUM | 135000 | 120000 | 0.160 |

An example of the use of some of the above materials for construction of the laminate follows:

| FACE | CENTER | BACK |
|---|---|---|
| 17-4 STAINLESS | 99.0% TITANIUM | 17-4 STAINLESS |
| 6-4 TITANIUM | 7075 ALUMINUM | 6-4 TITANIUM |
| BE—CU | 356 ALUMINUM | BE—CU |
| FORGING BRASS | 356 ALUMINUM | FORGING BRASS |
| 431 STAINLESS | 7075 ALUMINUM | 17-4 STAINLESS |

The above description and drawings are illustrative only since various components may be substituted attain the desired laminates. Accordingly, the scope of the invention is to be limited only by the following claims.

We claim:

1. A golf club head, comprising (a) a striking face area containing a recess;

(b) an insert secured within said recess, an outer surface of said insert being substantially flush with a non-recessed portion of said striking face area; and (c) said insert comprising a laminate including a pair of outer layers and at least one inner layer, said outer surface being arranged on one of said insert outer layers, said outer layers being formed of a different material having higher strength to weight characteristics than said at least one inner layer.

2. A golf club head as defined in claim 1, wherein said outer layers are formed of metal and have a greater weight than said at least one inner layer.

3. The club head of claim 2 wherein said outer layers of said laminate are 6–4 titanium and said inner layers are compression molded graphite.

4. The club head of claim 2 wherein said outer layers are 17–4 STAINLESS and said inner layers are 99.0% TITANIUM.

5. The club head of claim 2 wherein said outer layers are 6–4 TITANIUM and said inner layers are 7075 ALUMINUM.

6. The club head of claim 2 wherein said outer layers are BE-CU and said inner layers are 356 ALUMINUM.

7. The club head of claim 2 wherein said outer layers are 431 STAINLESS and said inner layers are 7075 ALUMINUM.

8. The club head of claim 2 wherein one of said outer layers of said laminate is 431 STAINLESS, said inner layers are 7075 ALUMINUM and the other outer layer is 17–4 STAINLESS.

9. The club head of claim 2 wherein one of said outer layers of said laminate is 304 STAINLESS, said inner layers are 356 ALUMINUM and the other outer layer is 7075 ALUMINUM.

10. The club head of claim 2 where said club head includes a plate member in said recessed area adjacent said insert.

11. The club head of claim 10 where said plate member is of a thickness between 0.030 and 0.120 inch.

12. A golf club head, comprising (a) a striking face area containing a recess;

(b) an insert secured within said recess, an outer surface of said insert being substantially flush with a non-recessed portion of said striking face area; and (c) said insert comprising a laminate including a pair of outer layers and at least one inner layer, said outer surface being arranged on one of said insert outer layers, said outer layers being formed of materials having a higher strength than that of said at least one inner layer.

* * * * *